US006070309A

United States Patent [19]

Wong

[11] Patent Number: 6,070,309

[45] Date of Patent: Jun. 6, 2000

[54] CONNECTOR FOR A STRAP END

[76] Inventor: Foo Yuen Wong, 149 W. 36th St., New York, N.Y. 10018

[21] Appl. No.: 09/131,795

[22] Filed: Aug. 10, 1998

[51] Int. Cl.[7] ..... A44B 17/00

[52] U.S. Cl. ..... 24/668

[58] Field of Search ..... 24/668, 669, 678, 24/666, 667, 670, 673, 674, 675, 676

[56] References Cited

U.S. PATENT DOCUMENTS 497,847 5/1893 White .
1,762,264 6/1930 Domkee .
1,890,692 12/1932 Mosgrove .
1,891,223 12/1932 Domkee .
1,916,010 6/1933 Mosgrove .
2,240,097 4/1941 Hotaling .

*Primary Examiner*—James R. Brittain
*Attorney, Agent, or Firm*—Myron Amer PC

[57] ABSTRACT

A suspender strap spring clip sized to engage a garment button in which size adjustments for a range of button diameters are possible, but only using tools with a mechanical advantage. Any manual-attempted size adjustment is prevented by friction in the clip construction so that it will not occur inadvertently.

2 Claims, 1 Drawing Sheet

CONNECTOR FOR A STRAP END

The present invention relates generally to improvements for a suspender or similar strap connection to an object to be supported therefrom, such as trousers, shorts or the like, wherein the improvements more particularly relate to a connector having significantly enhanced utility for the end purposes noted.

BACKGROUND OF THE INVENTION

A spring clip of wire construction material is the suspender/trouser connector of choice because of the ease of both establishing its engagement to a suspender button sewn on the garment and disengaging therefrom. To this purpose, the connector at its proximal end is appropriately attached to the strap and, at its distal end has a button holder of a circular configuration so as to have projected therein a suspender button, and between the proximal and distal ends the connector is configurated in an inverted or depending triangular shape which at its apex has edges bounding an opening into the button holder. To hold the button, and more particular the stem thereof, in place within the button holder, the opening noted is slightly undersized with respect to the diameter of the button stem so that a camming action is required for disengagement. That is, if there is no or very slight camming, the exiting movement could inadvertently occur from body movements of the user, such as sitting down or being jostled or the like, which is not desirable.

It is undoubtedly for this reason that a configuration embodied in a connector is selected to provide a specified width to the opening into the button holder sized to the diameter of the button stem, so as to require the camming for withdrawal from the button holder and, of course, unavoidably also during entry thereinto. To maintain the size relationship between the button holder opening and the button stem the embodied configuration of the connector is intentionally not allowed to be varied during use such as, most importantly, being manually spread apart which contributes to enlargement of the button holder opening possibly to an extent undermining its usefulness for the purposes intended.

An unavoidable consequence of an unvarying connector configuration is that its utility is limited to a narrow range that is dimensional either slightly plus or minus that of a specified button stem diameter.

SUMMARY OF THE INVENTION

Broadly, it is an object of the present invention to provide a wire suspender or strap connector overcoming the foregoing and other shortcomings of the prior art.

More particularly it is an object to provide a connector having a variable configuration in which tools having a mechanical advantage are required to force a configuration variation, but which otherwise cannot manually be varied by the user, so that a range of sizes of button stems are compatible with a single connector, all as will be better understood as the description proceeds.

BRIEF DESCRIPTION OF THE DRAWINGS

The description of the invention which follows, together with the accompanying drawings should not be construed as limiting the invention to the example shown and described, because those skilled in the art to which this invention appertains will be able to devise other forms thereof within the ambit of the appended claims.

DESCRIPTION OF PREFERRED EMBODIMENTS

Figure 1:
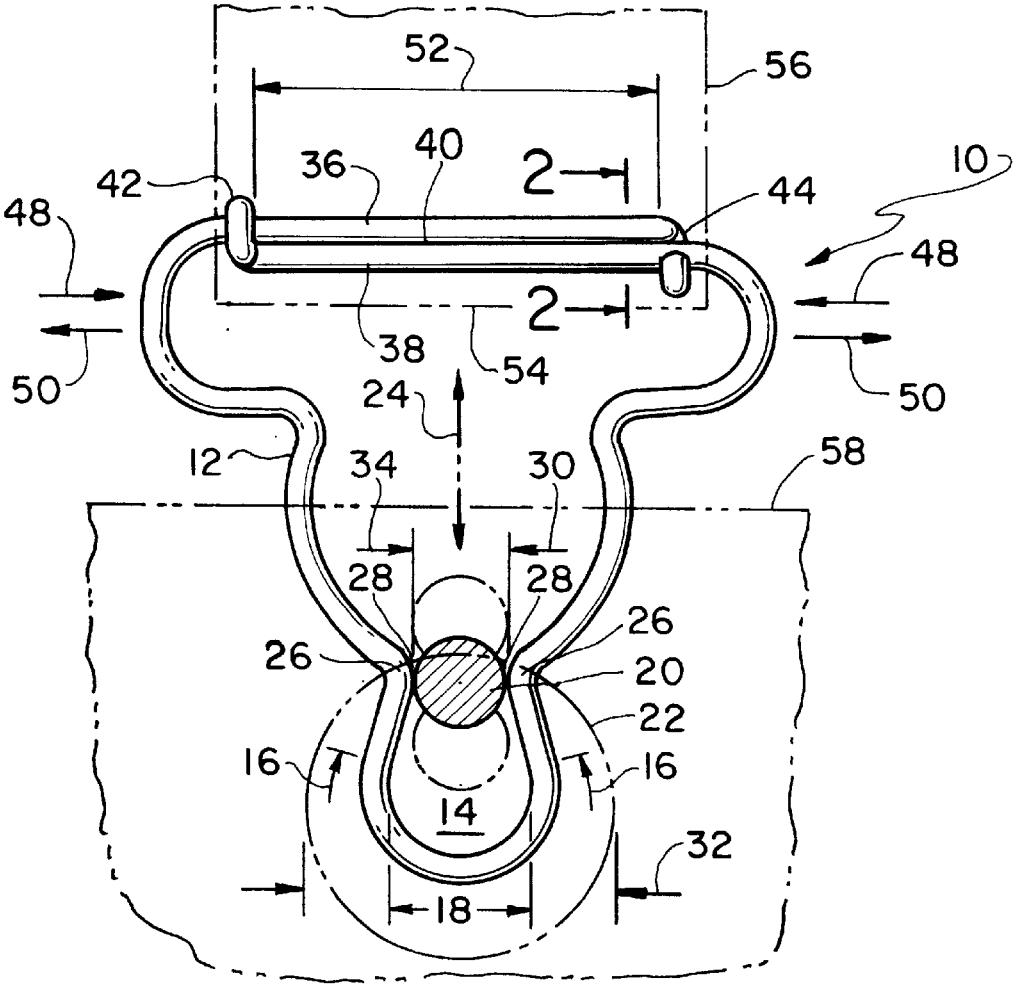
FIG. 1 is a front elevational view of the within inventive connector in which portions are shown in phantom perspective to better illustrate the intended manner of use thereof.

Shown in FIG. 1 is a connector, generally designated 10, fabricated from wire construction material, as noted at 12, into the shape or configuration as illustrated including a button-holder 14 of partial circular shape denoted by the arrows 16 and of a selected diameter 18 to encircle a button stem 20 of a larger diameter button 22. In use, the button stem 20 is positioned within the connector 10 on a positioning path of movement 24 above the button holder 14 so that relative movement of one or the other along the path of movement 24 enables the button stem 20 to cam apart opposite convexly curved ascending wire lengths 26 having edges 28 bounding an opening 30 in communication with the button stem-encircling button holder 14, and in which operative button stem position, the larger diameter 32 of the button 22 prevents disengagement of the button 22 except by a reverse directional movement along the positioning path of movement 24, to the end of obviating inadvertent disengagement of the connector 10 and button 22.

It is already known that the width 34 of the opening 30 must be constrained against an excessive enlargement, and thus in the prior art the upper wire lengths of the connector are physically interconnected to prevent an enlarging or opening degree of movement, one such prior art use of this technique being disclosed in U.S. Pat. No. 5,706,561 issued to Kipperman for "Spring Clip and Method for Making Same" on Jan. 13, 1998.

Underlying the present invention is the recognition that eschewing a physical interconnection in order to control the width size 34 of the opening 30, that there instead can be obtained a range of width sizes 34 by using friction fits established between the connector upper length portions. Stated somewhat differently, the friction fits offer a resistance to movement towards or away from each other which can be overcome but only with a mechanical advantage, but which resistance to movement is of an extent that cannot be overcome by the manual strength of the user, thus maintaining a selected stabilized opening width size 34 that will not contribute to inadvertent disengagement of the connector 10 and button 22.

Figure 2:
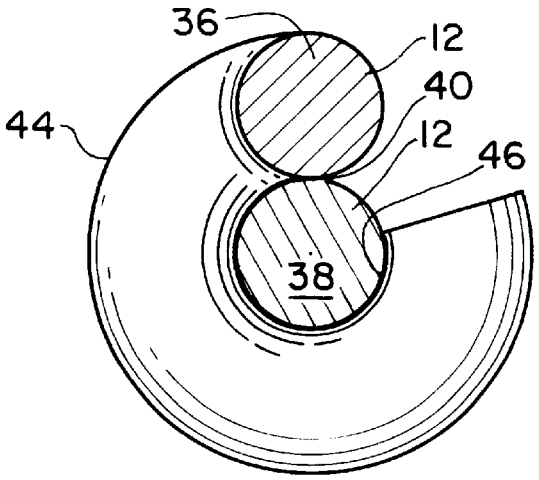
FIG. 2 is a sectional view, on an enlarged scale, as taken along line 2—2 of FIG. 1.

In the within inventive connector, the upper configuration is provided by two integral horizontally oriented length portions 36 and 38 in sliding relation, as at 40, with each other, and each having a free end respectively formed into circular configurations 42 and 44 in which the circular configuration of the one length portion is bent around and is in surface-to-surface contact, as at 46, with the other length portion, and vice versa, all as is best understood from the cross sectional view of FIG. 2. A kink (not shown) can optionally be embodied in the circular configurations 42, 44 to enhance the firmness of the surface-to-surface contact 46.

From the description already provided, it should be readily appreciated that tool-applied directional forces 48 and 50 will vary the clearance 52 between the circular configurations 42 and 44 and correspondingly will regulate the width size 34 of the opening 30 in relation to the width of the button stem.

For completeness sake it is noted that the top of the connector 10 is conveniently disposed in a loop 54 of a suspender strap 56 so that relative movement between the connector 10 and the button 22 attached by stitching to a lower torso article of manufacture 58 will facilitate attachment therebetween to provide suspender support of the lower torso garment 58.

The present invention also contemplates the use of the connector 10 for connecting the end of an elastic strap of a closure panel to a button on a backpack (not shown), or in similar end uses.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A connector of wire construction material of a type used in detachably connecting an end of a suspender strap to a lower torso article of manufacture comprising a circular button on said lower torso article of manufacture having a stem of a selected diameter less than that of said button, a button-holder having a proximal end and a distal end, a partial circular shape and of a selected diameter disposed at said distal end to encircle said button stem, operative positions of said button stem and said button-holder in a positioning path of movement relative to each other, edges in ascending relation from said button-holder integral to said partial circular shape thereof bounding an opening into said button-holder, a pair of first and second horizontally oriented length portions integral to said opening-bounding edges disposed at said proximal end and in sliding relation to each other and each having a free end, and a circular configuration on one said length portion end and a circular configuration on said other length portion end each disposed in encircling relation providing a friction grip about said other length portion of a selected extent exceeding manual strength to overcome said friction thereof, said length portions bounding a horizontally oriented positioning clearance of a selected length therebetween, said first and second length portions being unattached to each other except for said friction grips so as to partake of sliding movement relative to each for all or any selected length of said length of said positioning clearance, whereby using a compressing and expanding tool means having a mechanical advantage said positioning clearance is adjustable in size to provide a width to said opening into said button-holder slightly undersized in relation to said diameter of said button stem.

2. A connector of wire construction material of a type detachably connecting an end of a strap to an article of manufacture comprising a circular button on said article of manufacture having a stem of a selected diameter to encircle said button stem, operative positions of said button stem and said button-holder in a positioning path of movement relative to each other, opposite convexly curved edges in successive progressively converging and progressively diverging relation bounding an opening into said button-holder, a pair of adjacent oriented length portions integral to said opening-bounding edges disposed in sliding relation to each other and each having a free end, and a circular configuration on one said length portion end, and a circular configuration on said other length portion end each disposed in a friction fit about said other length portion so as to bound a positioning clearance therebetween, whereby using a compressing and expanding tool means having a mechanical advantage said positioning clearance is adjustable in size to provide a width to said opening into said button-holder slightly undersized in relation to said diameter of said button stem.

* * * * *